US008374369B2

(12) United States Patent
Nikles et al.

(10) Patent No.: US 8,374,369 B2
(45) Date of Patent: Feb. 12, 2013

(54) ASSEMBLY DEVICE FOR A COMPONENT OF A HEARING APPARATUS AND CORRESPONDING METHOD

(75) Inventors: Peter Nikles, Erlangen (DE); Benjamin Schmidt, Nürnberg (DE); Christian Schmitt, Grossenseebach (DE); Erwin Singer, Eckental (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1009 days.

(21) Appl. No.: 11/974,884

(22) Filed: Oct. 16, 2007

(65) Prior Publication Data

US 2009/0175475 A1 Jul. 9, 2009

Related U.S. Application Data

(60) Provisional application No. 60/852,123, filed on Oct. 16, 2006.

(51) Int. Cl.
*H04R 25/00* (2006.01)

(52) U.S. Cl. ..... 381/324; 381/87

(58) Field of Classification Search ..... 381/324
See application file for complete search history.

(56) References Cited

U.S. PATENT DOCUMENTS

| | | | | |
|---|---|---|---|---|
| 4,598,177 | A * | 7/1986 | McGroarty et al. | 381/323 |
| 5,201,008 | A * | 4/1993 | Arndt et al. | 381/323 |
| 5,347,584 | A * | 9/1994 | Narisawa | 381/323 |
| 5,889,874 | A * | 3/1999 | Schmitt et al. | 381/328 |
| 6,041,128 | A * | 3/2000 | Narisawa et al. | 381/322 |
| 6,879,697 | B2 * | 4/2005 | Tøpholm | 381/322 |
| 2003/0059076 | A1 * | 3/2003 | Martin | 381/331 |
| 2003/0179895 | A1 * | 9/2003 | Doudoukjian | 381/322 |
| 2005/0157898 | A1 * | 7/2005 | Gabathuler | 381/322 |
| 2008/0126062 | A1 | 5/2008 | Nikles et al. | |

FOREIGN PATENT DOCUMENTS

| | | |
|---|---|---|
| DE | 3601441 A1 | 7/1987 |
| EP | 1435758 A1 | 7/2004 |
| EP | 1583395 | 10/2005 |

* cited by examiner

*Primary Examiner* — Christopher Uhlir

(57) ABSTRACT

Hearing apparatuses and in particular hearing devices are to be designed to be smaller. To this end, provision is made for an assembly device for fastening a component in the housing of a hearing apparatus with a first arm for retaining the component and a second arm, which can be plugged at least partially into/onto a corresponding fastening element on the interior of the housing. A hinge connects the two arms in a pivotable fashion. After connecting the assembly device to the fastening element, the two arms are snapped onto one another by pivoting about the hinge and thus adopt a final assembly position. This retractable mechanism also allows the use of space below a cover segment of the housing.

11 Claims, 3 Drawing Sheets

ASSEMBLY DEVICE FOR A COMPONENT OF A HEARING APPARATUS AND CORRESPONDING METHOD

CROSS REFERENCE TO RELATED APPLICATIONS

The present application claims the benefit of the provisional patent application filed on Oct. 16, 2006, and assigned application No. 60/852,123, and is incorporated by reference herein in its entirety.

FIELD OF THE INVENTION

The present invention relates to an assembly device for fastening a component in the housing of a hearing apparatus. Furthermore, the present invention relates to a method for fastening a component with the aid of an assembly device of this type. The term "hearing apparatus" is understood here to mean in particular a hearing device which can be worn on the head, but also a headset or earphones.

BACKGROUND OF THE INVENTION

Hearing devices are portable hearing apparatuses which are used to supply the hard-of-hearing. To accommodate the numerous individual requirements, different configurations of hearing devices such as behind-the-ear hearing devices (BTE), in-the-ear hearing devices (ITE) and concha hearing devices are provided. The hearing devices designed by way of example are worn on the outer ear or in the auditory canal. Furthermore, bone conduction hearing aids, implantable or vibrotactile hearing aids are also available on the market. The damaged ear is herewith either stimulated mechanically or electrically.

Essential components of the hearing devices include in principle an input converter, an amplifier and an output converter. The input converter is generally a receiving transducer, e.g. a microphone and/or an electromagnetic receiver, e.g. an induction coil. The output converter is mostly realized as an electroacoustic converter, e.g. a miniature loudspeaker, or as an electromechanical converter, e.g. a bone conduction receiver. The amplifier is usually integrated into a signal processing unit. This basic configuration is shown in the example in FIG. 1 of a behind-the-ear hearing device. One or a number of microphones 2 for recording the ambient sound are incorporated in a hearing device housing 1 to be worn behind the ear. A signal processing unit 3, which is similarly integrated into the hearing device housing 1, processes the microphone signals and amplifies them. The output signal of the signal processing unit 3 is transmitted to a loudspeaker and/or receiver 4, which outputs an acoustic signal. The sound is optionally transmitted to the ear drum of the device wearer via a sound tube, which is fixed with an otoplastic in the auditory canal. The power supply of the hearing device and in particular of the signal processing unit 3 is provided by a battery 5 which is likewise integrated into the hearing device housing 1.

During telephone calls, it is favorable if signals are not transmitted acoustically from the telephone to the hearing device, but are instead transmitted inductively in an interference-free manner. To this end, receiver coils are used in the hearing device, which are to be set up in a suitable manner. Furthermore, coils of this type can also be used as transmission coils for inductive transmission to an external device, e.g. second hearing device, remote controller etc.

To integrate the inductive antennae and/or coil into ITEs, the coil was previously positioned on the faceplate in a fixed manner. For manufacturing-specific reasons there was no other way of doing this. The new computer-aided manufacture of ITEs has enabled the coil to be individually positioned in the hearing device shell for some time. The spaces available in the individual shell can herewith be better utilized, so that either the hearing device is reduced in size or a coil can even be provided in the hearing device. Within the scope of this computer-aided manufacture, so-called "semi-modular faceplates" are produced, in which the faceplate and the coil are not realized as a fixed module. Instead, the coil is only connected to the faceplate by way of an electrical line, but is otherwise structurally separated from the faceplate. One advantage of this solution is however that the coil can be positioned and oriented independently of the faceplate in the hearing device shell.

Installing the coil at the individual location nevertheless results in a number of problems: The hearing device shell of an ITE only comprises one small opening, through which the coil has to be inserted and positioned. Furthermore, the holder of the coil is not permitted to "block" the sound channel during installation and the holder has to be able to be disassembled from the shell for repair work, in order to be able to replace the receiver which sits further inside the hearing device shell. In addition, the individually positionable coil is required to be able to be arranged at any point in the shell, so that no unnecessary space is used.

The publication EP 1 435 758 A1 discloses a housing for a hearing device with a housing shell, a device plate connected to the housing shell and a cover arranged on the housing shell or the device plate, in which cover an electronic element is arranged. The cover is mounted in a pivotable fashion on a hinge element of the device plate by way of a pin for instance. The hinge element comprises for its part electrical contact studs, in order to realize an electrical contact with contact strips on the cover, when the cover is in a pivoted state.

SUMMARY OF THE INVENTION

The object of the present invention thus consists in being able to assemble a component in the housing of a hearing apparatus in a simple fashion and without wasting space.

In accordance with the invention, this object is achieved by an assembly device for fastening a component in the housing of a hearing apparatus with a first arm for retaining the component, a second arm, which can be plugged at least partially into/onto a corresponding fastening element on the interior of the housing, a hinge, with which the two arms are connected in a pivotable fashion, with the two arms being snapped onto one another in a predeterminable pivot position, which corresponds to an assembly position.

Furthermore, provision is made in accordance with the invention for a method for fastening a component in the housing of a hearing apparatus with the aid of an aforementioned assembly device by fastening the component on the first arm, plugging at least one part of the second arm into the fastening element on the inside of the housing and snapping the two arms onto one another, so that they adopt a predeterminable pivot position, which corresponds to a final assembly position.

It is advantageously possible by means of the retractable mechanism according to the invention to position the coil up to the roof of the shell. Space below the "roof" is normally required in order to insert and/or engage the coil into the corresponding fastening facility on the shell. Consequently, smaller hearing devices can thus be realized. Furthermore, the coil can be easily fixed into the defined position by means of the engaging mechanism. Engaging and/or snapping-on is self-evident during assembly and signals the correct fixing.

The assembly device according to the invention is injection-molded from plastic in one piece. Clear advantages herewith result in terms of production and assembly costs.

With a special embodiment, the first arm can comprise a joining component for snapping onto the component to be assembled in a releasable fashion. The component to be assembled can herewith be fastened to the assembly device using one simple hand movement and can be detached again if necessary for repair and exchange purposes.

Furthermore, the second arm can comprise a hook for insertion into the fastening element on the interior of the housing. The hook can in particular be embodied such that at the free end of the second arm, it projects vertically herefrom, so that it can be constantly monitored during insertion into a corresponding rail.

It is also advantageous for the two arms to be snapped onto one another in the final assembly position in a releasable fashion. A simple assembly as well as a simple disassembly thus both result in the event of repair and/or exchange.

The component to be assembled can be an electronics component and in particular a coil and/or antenna. More allowance can thus be made for the orientation of the magnetic field during inductive transmission by means of individually positioning the coil.

Particular advantages can be expected during assembly of a component with an assembly device of this type in a hearing device shell, which here has the function of the housing. Special advantages result for the positioning of a coil in a BTE shell.

The fastening element on the housing can be a rail. The component to be fastened can thus be easily guided into the desired position.

BRIEF DESCRIPTION OF THE DRAWINGS

The present invention is described in more detail with reference to the appended drawings, in which.

DETAILED DESCRIPTION OF THE INVENTION

The exemplary embodiment illustrated in more detail below represents a preferred embodiment of the present invention. Fastening a coil in an ITE shell is selected here as an example. The claimed assembly device is thus realized here as a coil holder.

Figure 1:
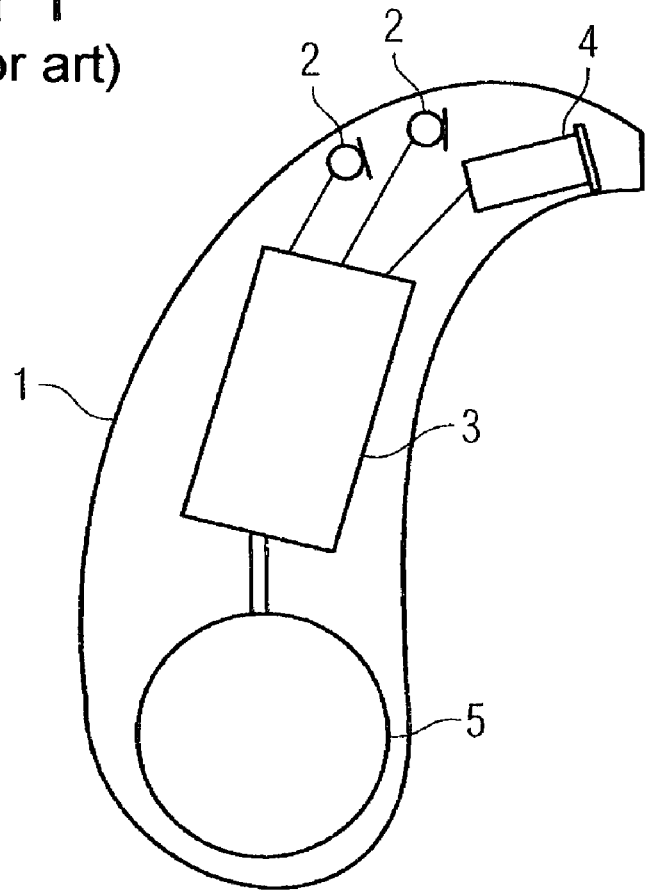
FIG 1 (Prior art)
FIG. 1 shows the basic design of a hearing device.
Figure 2:
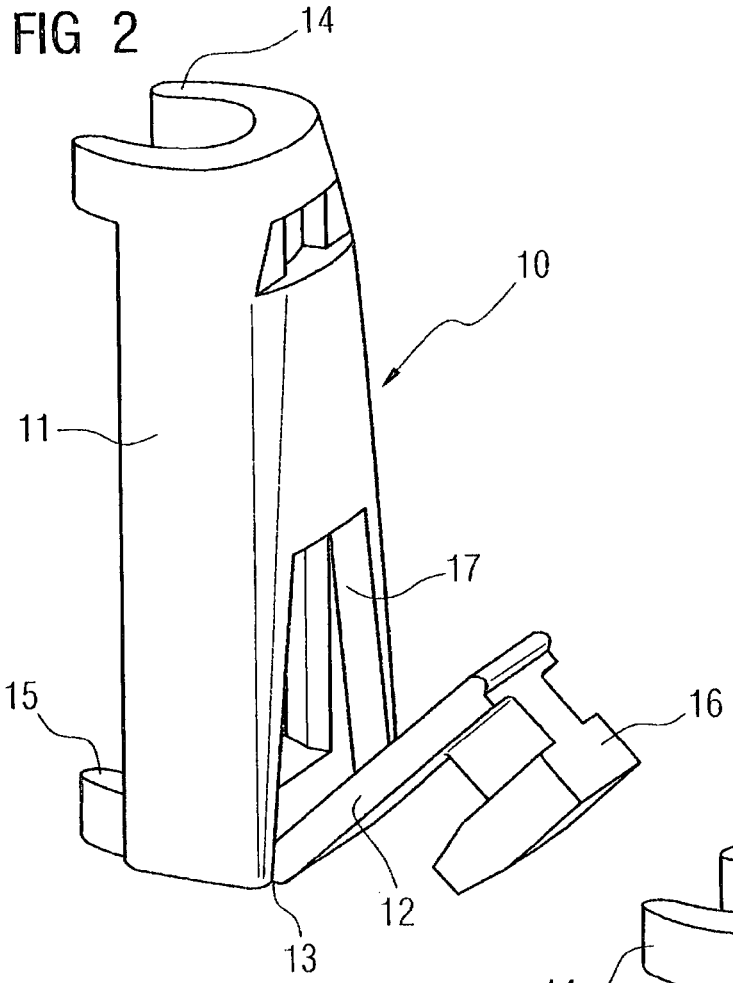
FIG. 2 shows an assembly device according to the invention in an assembly position.

The coil holder 10 shown in FIG. 2 consists of a first arm 11 and a second arm 12. The two arms 11, 12 are connected with one another by way of a film hinge 13.

Joining clips 14 and 15 are located on both ends of the first arm 11, into which joining clips a coil (not shown here) can be pressed. The coil then engages into these joining clips 14, 15 in a releasable fashion.

The second arm 12 has a hook 16 on its free end. This hook 16 is embodied in the manner of a slide. It can thus be inserted into a corresponding slide rail (see FIG. 4) of a hearing device shell. The free end of the hook 16 thus represents a limit stop on the slide rail. It is also meaningful in this example for the hook 16 to protrude essentially vertically from the second arm 12 and for the slide-like segment of the hook 16 to be designed in parallel with the second arm 12.

The two arms 11 and 12 can be pivoted relative to one another by means of the hinge 13. FIG. 2 shows the two arms 11, 12 in a V-shaped position relative to one another. In this position, the coil is inserted into the hearing device shell (compare FIG. 4).

Figure 3:
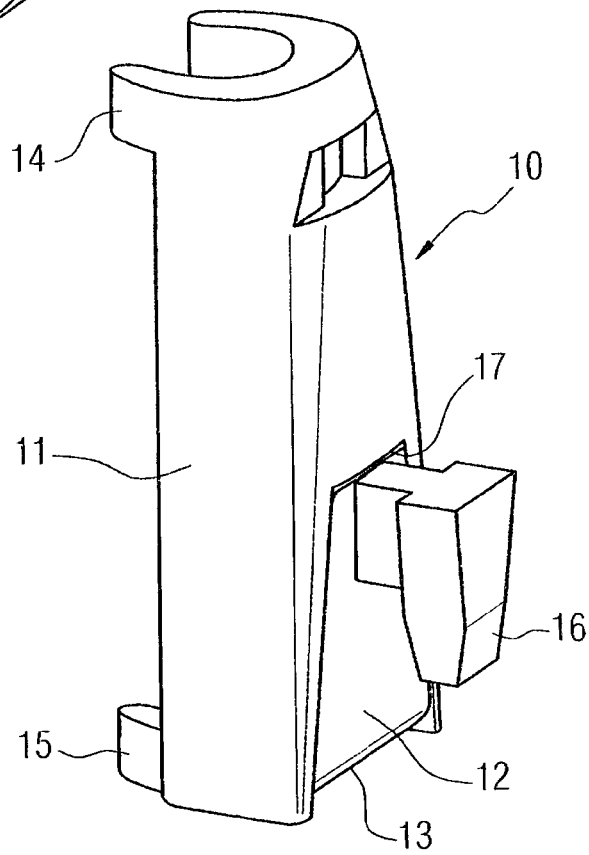
FIG. 3 shows the assembly device in FIG. 2 in a final assembly position.

FIG. 3 shows the coil holder in a final assembly position. The arms 11 and 12 are herewith clicked into one another. This means that the two arms 11, 12 are locked with one another in this position in a releasable fashion. To realize this releasable snap-on connection and/or locking connection, the two arms 11, 12 are designed with undercuts in a manner known per se etc.

In the example in FIGS. 2 and 3, the first arm 11 has a recess 17, into which the second arm 12 can be completely pushed with the exception of the hook 16. When the final assembly position is in a snapped-on state according to FIG. 3, the surfaces of the two arms 11 and 12 are thus flush. Only the hook 16 protrudes from the common surface.

Figure 4:
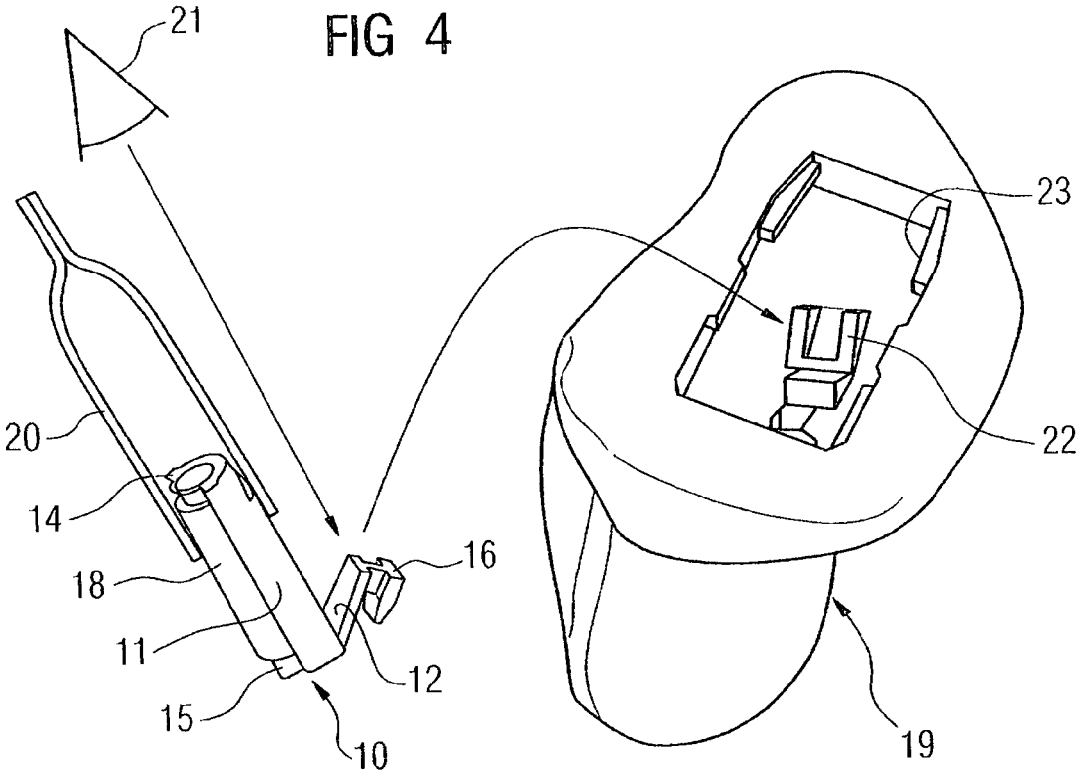
FIG. 4 shows an ITE shell and a shell to be assembled with an assembly device as well as FIG. 5 shows a cross-section through the ITE shell with an assembled receiver and assembled coil.

FIG. 4 symbolizes the assembly of a coil 18 with the aid of the coil holder 10 in an ITE shell 19. The coil 18 is pressed into the joining clips 14, 15 of the coil holder 10. The two arms of the coil holder 10 are disposed in the V-shaped position shown in FIG. 2.

For the assembly, the technician grips the coil holder 10 including the coil 18 using tweezers 20. During installation into the hearing device shell 19, the hook 16 is always in the field of view of the technician, symbolized by means of an eye 21. As the hook 16 is neither covered by the assembly tool 20 or the coil holder 10 itself during installation, it can be easily inserted into a rail 22 molded onto the interior wall of the hearing device shell 19. This visibility of the hook 16 also causes the number of locations in the shell 19, on which the coil 18 can be fastened without any great effort, to increase. In particular, it can also be inserted through a very small opening 23 in the hearing device shell, and the joining parts remain easily identifiable.

The visibility of the hook during assembly is another reason why the location of the hook 16 in the rail 22 (e.g. SLA rail) can be easily examined. In particular, it is easy to identify whether the hook 16 is completely inserted into the rail 22 and rests with its tip against the corresponding limit stop. Overall, this also ensures that the coil 18 is well positioned, thereby also resulting in improved product quality. Furthermore, the hook 16 can be inserted into the rail 22 very quickly, thereby also resulting in an increased assembly speed.

For additional fixing, after insertion of the hook 16 into the rail 22, a drop of adhesive can be applied hereto. The adhesive herewith fixes the hook from above. If the intention is to be able to disassemble the coil 18 again, it is favorable to use an easily removable adhesive, e.g. silicon. Applying an adhesive prior to the assembly of the holder into the SLA rail would lead to problems during disassembly. The SLA rail could be destroyed and thus the entire SLA shell (SLA=Stereo Lithography Apparatus).

Figure 5:
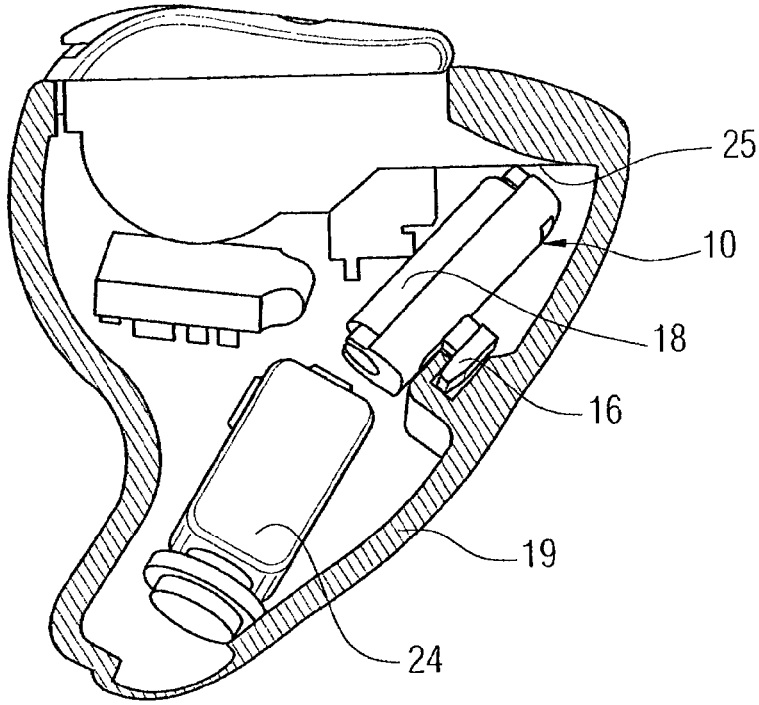

The hook 16 which is visible during assembly now allows the coil holder 10 to be securely inserted into the very small rail 22. As the last assembly step, only the first arm 11, on which the coil 18 is fastened, need be pressed onto the second arm 12. The arms 11, 12 herewith lock into/onto one another. The technician is able to detect and/or feel this locking/snapping. The position of the holder 10 and the coil 18 within the ITE shell 19, as shown in FIG. 5, herewith finally results. FIG.

5 also shows how coil holder 10 and coil 18 are arranged above a receiver 24 in the hearing device shell 19. For the coil 18, the space between the receiver 24 and a "roof" 25, which upwardly delimits the interior space of the hearing device shell 19, can thus be almost completely utilized. This is symbolized in the drawings in that an approximate 0 mm distance exists between the upper edge of the coil 18 and/or the coil holder 10 and the roof 25. The space utilization can be achieved despite the fact that a displacement path of approximately 1.5 mm is necessary in order to insert the hook 16 into the rail 22. A prerequisite herefor is however the inventive retractable mechanism of the coil holder 10.

The invention claimed is:

1. An assembly device for fastening a component through an opening and into an interior of a housing of a hearing apparatus, the assembly device comprising:

a first arm configured to retain the component;

a second arm configured to be removably inserted through the opening in the housing into a fastening element located below a roof of the housing within the interior of the housing to provide a removable connection between the assembly device and the housing of the hearing apparatus, wherein the second arm comprises a hook parallel with the second arm and arranged to be slidably inserted into or removed from the fastening element in respective directions downward away from or upward toward the roof of the housing, wherein the fastening element comprises a slide rail on the housing, wherein an end section of the hook is arranged to provide a downward travel limit stop relative to the slide rail; and a hinge that pivotally connects and rotates the first and the second aims between an installation position with the first and second aims pivoted apart and an assembly position with the first and second arms pivoted together, wherein with the hinge in the installation position, engagement of the hook and the fastening element can be observed through the opening from outside the housing; and wherein with hook and fastening element engaged and the hinge in the assembly position, the first and the second arms are configured to be snapped onto one another in the assembly position such that the first arm restricts observation of the hook and fastening element from outside the housing, wherein the assembly device, when connected to the housing and in the assembly position, is located in an interior space defined by the housing of the hearing apparatus.

2. The assembly device as claimed in claim 1, wherein the assembly device is injection molded from a plastic in one piece.

3. The assembly device as claimed in claim 1, wherein the first arm comprises a joining part for a releasable snapping-on of the component.

4. The assembly device as claimed in claim 1, wherein the first and the second arms are releasable snapped onto one another in the assembly position.

5. The assembly device as claimed in claim 1, wherein the component is an electronic component.

6. The assembly device as claimed in claim 5, wherein the electronic component is a coil.

7. A method for installing a component through an opening in a housing of a hearing apparatus into a fastening element located on a wall below a roof within an interior of the housing by way of an assembly device, the method comprising:

pivotally joining a first arm and a second arm of the assembly device;

fastening the component to the first arm of the assembly device the second arm comprises a free end parallel with the second arm;

with the first arm and second arm pivoted apart, removeably inserting a free end of the second arm of the assembly device into the fastening element in the interior of the housing, the removably inserting providing a removable connection between the assembly device and the housing of the hearing apparatus, wherein the fastening element comprises a slide rail on the housing, and the pivoting apart of the first arm and second arm allowing observation, from outside the housing through the opening, of the inserting of the free end of the second aim into the fastening element;

pivoting the first arm and second arm together and snapping the first and the second arms onto one another to an assembly position wherein the free end and the fastening element are engaged and the hinge is in the assembly position such that the first arm restricts observation of the free end and fastening element from outside the housing; and locating the assembly device, when connected to the housing and in the assembly position, in the interior of the housing of the hearing apparatus.

8. The method of claim 7, further comprising applying an adhesive to the free end of the second aim and the fastening element only after they are engaged.

9. A hearing apparatus comprising:

a housing defining an interior and comprising a wall and a roof disposed above the wall, and an opening through the housing providing access to the interior from outside the housing;

a rail connected to the wall within the interior of the housing;

a coil holder comprising a first aim pivotally connected to a second arm;

a coil connected to the first arm;

a hook formed at a free end of the second arm and parallel with the second arm, configured to slidably engage the rail when said second arm is inserted or removed through the opening of the housing;

wherein with the first and second arms pivoted away from each other, engagement of the hook and rail can be observed from outside the housing through the opening; and wherein with the first and second arms pivoted toward each other to place the coil holder into an assembled position, the first arm and coil cover the hook and rail so that engagement of the hook and rail can no longer be observed from outside the housing through the opening.

10. The hearing apparatus of claim 9, further comprising:

the rail disposed on the wall at a first distance below the roof; and the first arm and coil extending beyond the hook such that the first aim and coil are disposed below the roof by a distance less than the first distance when the coil holder is in the assembled position.

11. The hearing apparatus of claim 9, further comprising an adhesive disposed onto the hook and rail after the hook is engaged with the rail.

* * * * *